US005506675A

United States Patent [19]

Lopez et al.

[11] Patent Number: 5,506,675

[45] Date of Patent: Apr. 9, 1996

[54] LASER TARGET DESIGNATOR TESTER FOR MEASURING STATIC AND DYNAMIC ERROR

[75] Inventors: Marco A. Lopez, Villa Park; Thomas E. Godfrey, Orange, both of Calif.

[73] Assignee: Northrop Grumman Corporation, Los Angeles, Calif.

[21] Appl. No.: 212,757

[22] Filed: Mar. 11, 1994

[51] Int. Cl.[6] ..... G01B 11/26; G01C 1/00; F41G 7/00; G01J 5/02

[52] U.S. Cl. ..... 356/152.1; 250/342; 244/3.13; 356/152.2; 356/153

[58] Field of Search ..... 356/152.1, 152.2, 356/153; 244/3.13; 250/342

[56] References Cited

U.S. PATENT DOCUMENTS 4,385,834 5/1983 Maxwell, Jr. ..... 356/153

4,669,809 6/1987 Patry et al. .

5,197,691 3/1993 Amon et al. ..... 244/3.13

*Primary Examiner*—Stephen C. Buczinski

*Attorney, Agent, or Firm*—Terry J. Anderson; Karl J. Hoch, Jr.

[57] ABSTRACT

A method of testing a laser target designator, in which an aperture in the field of view of the laser target designator has one side facing the target image detector and the laser, a beam image detector faces an opposite side of the aperture and is aligned with the opening thereof so that the beam optical axis and the opposite side of the aperture are in a field of view of the beam image detector, both sides of the aperture being illuminated, and beam video processor obtains a test video image from the beam image detector and computes a centroid of the aperture in the test video image and a centroid of the laser beam in the test video image, the displacement of these centroids being a measure of the static error while relative movement of them during dithering of the optical path from the laser target designator is a measure of the dynamic error.

10 Claims, 5 Drawing Sheets

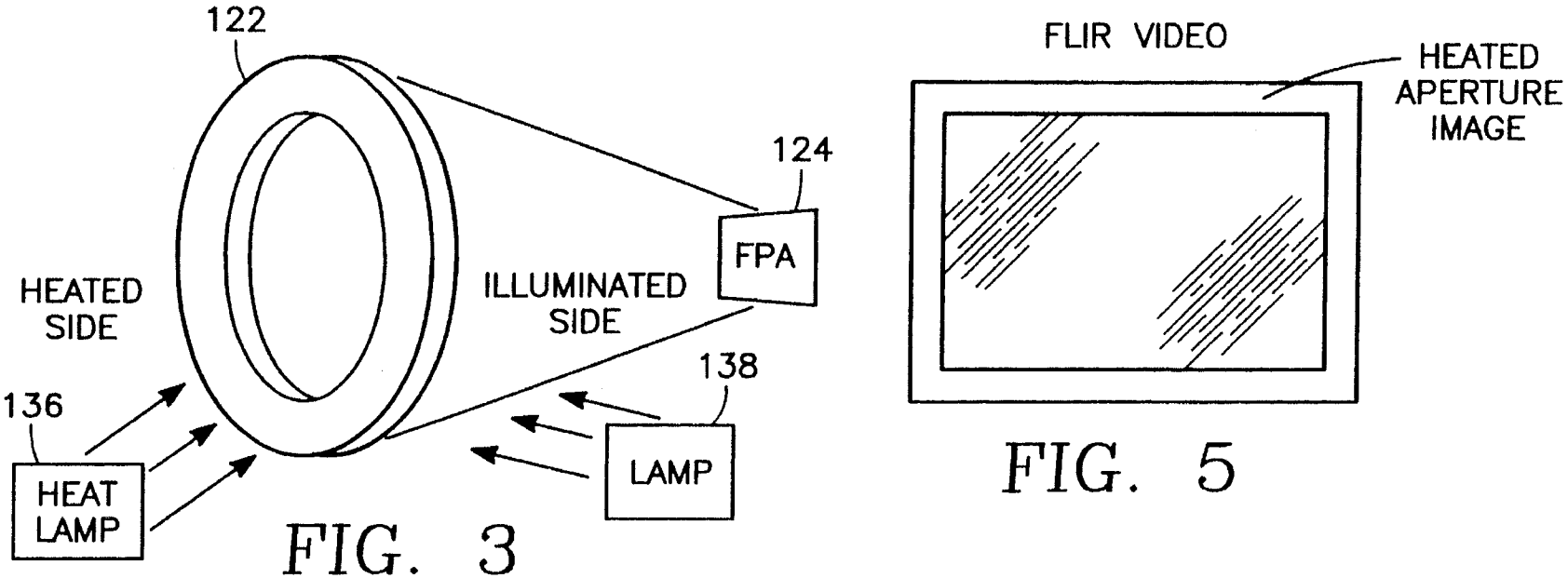
FIG. 3
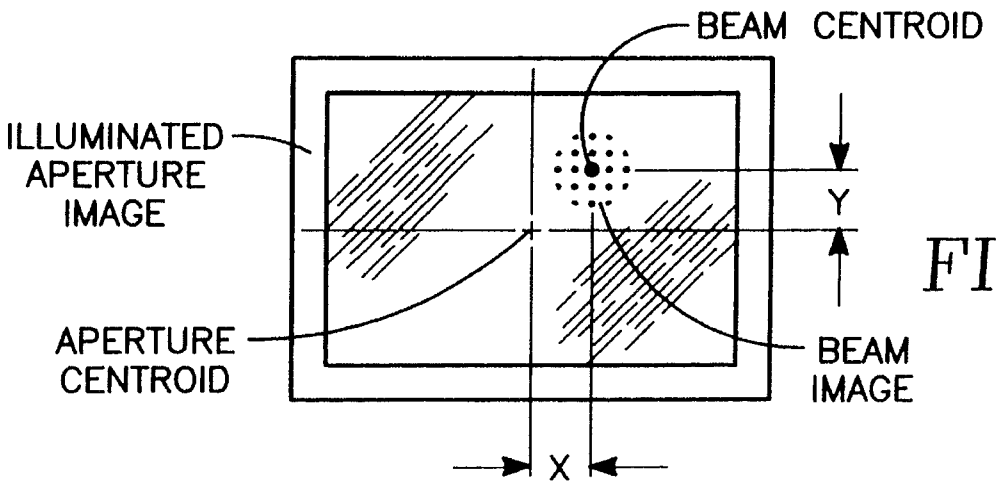
FIG. 4
FIG. 5

LASER TARGET DESIGNATOR TESTER FOR MEASURING STATIC AND DYNAMIC ERROR

BACKGROUND OF THE INVENTION

1. Technical Field

The invention is related to methods for testing laser target designator systems and in particular to methods for determining both (1) the amount of static misalignment or boresight error between an imaging aim sensor and the laser of the apparatus and (2) the dynamic tracking error of the apparatus.

2. Background Art

Referring to FIG. 1, a laser target designator to be tested (unit under test or UUT) 100 includes an imaging sensor such as a forward looking infrared (FLIR) sensor 102 (and/or a visual sensor) and a laser 104. Any misalignment will cause the laser 104 to illuminate objects not at the center of the field of view of the FLIR 102. The FLIR 102 permits a human operator to place the beam of the laser 104 onto an object by moving the laser target designator or UUT 100 until the desired object is in the center of the field of view of the FLIR 102, typically indicated by cross-hairs in a video display generated by the FLIR 102.

A serious problem with laser target designators is that any misalignment between the optical axes 106, 108 of the FLIR 102 and laser 104, respectively, may cause an object other than that centered by the operator in the FLIR video image cross hairs to be illuminated by the laser 104. Such an error is referred to herein as static error or static boresight error. In those applications in which a "smart" weapon flies to the object illuminated by the laser 104, such an error is unacceptable.

Once the operator locates the FLIR video display cross hairs onto a desired target in the image, he can command a FLIR video processor 110 to have a servo move the FLIR 102 and laser 104 together so as to follow any movement of the target to maintain it in the cross hairs. For this purpose, the FLIR video processor 110 controls a pair of servos 112, 114 controlling rotation of a gimballed platform 116 about horizontal and vertical axes 118, 120, respectively. The FLIR 102 and the laser 104 are mounted on the platform 116 and therefore move with it. The FLIR video processor 110 performs video tracking control of the type well-known in the art, using conventional video processing and feedback control techniques to track a target in the image so that the laser 104 continues to illuminate the target as long as the operator desires even while the target is moving.

One problem with such a video tracking system is that there are certain inherent inaccuracies and delays arising from two sources of error. One error source is the electromechanical limitations of the servos 112, 114 and the gimbal mechanics associated therewith. Another error source is the electronic limitations of the FLIR video processor 110 and the limited image resolution of the video image with which the processor 110 must work with. Yet another error source is the alignment error between the laser and its aim reticles. Together, these error sources give rise to significant delays and inaccuracies of the video tracking system. As a result, the laser beam does not accurately follow a moving target and there is therefore some risk that a quickly moving target can evade the laser guided weapon. This latter servo error is referred to herein as dynamic error.

Another major problem with such tracking systems is that laser target designators must be tested prior to actual use in order to verify that the static boresight error is within acceptable limits. The FLIR 102 operates in the 8–12 micron wavelength region while the laser 104 typically operates in the 1.06 micron wavelength region. Automatic measurement of misalignment between the FLIR and laser optical axes 106, 108 typically has required either expensive multispectral beam splitters or movement of optical elements to switch between (1) a thermal source which stimulates the FLIR 102 at infrared wavelengths and (2) an optical sensor which senses the beam from the laser 104 at optical wavelengths. These elements introduce large errors due to vibration and time-dependent thermal drift.

Some testing techniques try to improve accuracy by introducing a glass target illuminated by the laser 104, the FLIR 102 sensing the hot spot thus produced in the glass target. This produces an image which the operator can check for misalignment of the laser beam relative to the center of the field of view of the FLIR 102. The problem with such an approach is that the hot spot can move due to vibration, and it diffuses over time, making the misalignment measurement unreliable. Also, such a method cannot measure dynamic error.

One limitation of the testing technique illustrated in FIG. 1 is that the displacement between the optical paths of the laser 104 and the FLIR 102 requires a long range to the field target board for accurate results, a significant disadvantage.

Due to the foregoing problems, measurements of static error in a laser target designator have been accurate to on the order of only a few milliradians, whereas it is necessary to be able to measure such errors to within fractions (e.g., hundredths) of one milliradian. Moreover, the need to measure the dynamic error of a laser target designator in the laboratory or portable shelter has not been substantively addressed in the art.

SUMMARY OF THE DISCLOSURE

The invention is a method of testing a laser target designator, the laser target designator including a laser for radiating a laser beam along a beam optical axis, a target image detector for viewing an image in a field of view into which the laser beam extends along the beam optical axis, a servo for moving the laser and detector together and a video processor to track the servo to a moving target in the field of view. An optical system such as a double rhomboid assembly shifts the optical path of the laser into the center of the FLIR aperture so that their optical paths merge into a coaxial optical path within a very short length, a significant advantage. In accordance with the invention, an aperture in the field of view has one side facing the target image detector and the laser, the aperture being aligned relative to the laser so that the beam optical axis extends through an opening of the aperture. A beam image detector faces an opposite side of the aperture and is aligned with the opening thereof so that the beam optical axis and the opposite side of the aperture are in a field of view of the beam image detector. The one side of the aperture is illuminated with light of a wavelength detectable by the target image detector and the opposite side of the aperture is illuminated with light of a wavelength detectable by the beam image detector. A beam video processor obtains a test video image from the beam image detector and computes a centroid of the aperture in the test video image and a centroid of the laser beam in the test video image, the displacement of these centroids being a measure of the static error.

In accordance with a further aspect of the invention, a mirror in an optical path between the aperture and the laser target designator is dithered while the target detector video processor is locked onto an image of the aperture. The beam video processor computes a path of the centroid of the laser beam in the test video image and computes a radius of the path as a measure of dynamic error.

BRIEF DESCRIPTION OF THE DRAWINGS

FIG. 3 is a simplified perspective view of a target aperture of the system of FIG. 2.

FIG. 4 is a diagram of a focal plane array video image obtained in the system of FIG. 2.

FIG. 5 is a diagram of a FLIR video image obtained in the system of FIG. 2.

DETAILED DESCRIPTION OF THE PREFERRED EMBODIMENTS

In the present invention, all of the foregoing problems are solved in a manner that enables measurement of both dynamic and static error in a laser target designator to within hundredths of a degree.

Static Error Measurement

Figure 1:
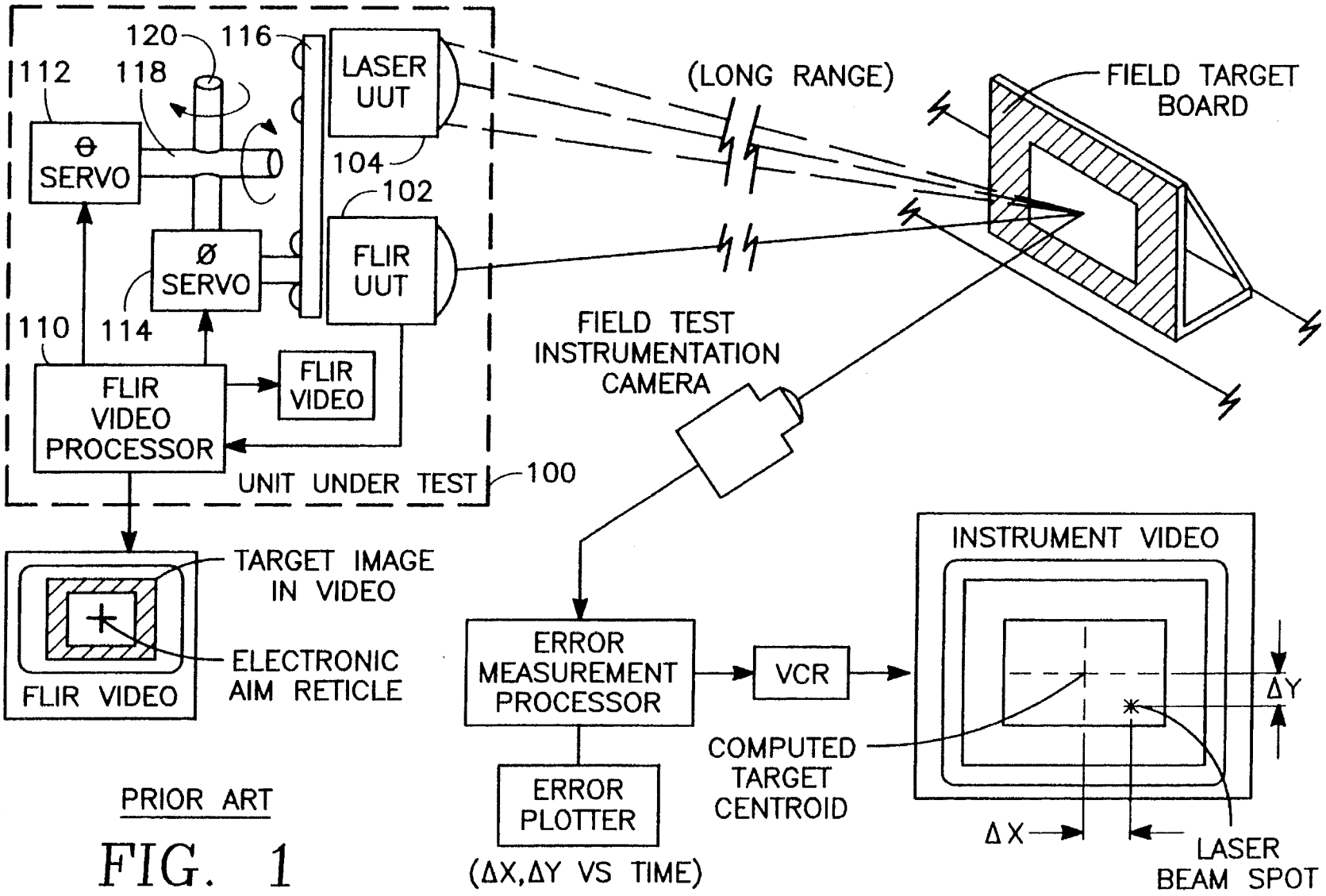
PRIOR ART FIG. 1
FIG. 1 is a simplified schematic diagram of a laser target designator testing apparatus of the prior art.
Figure 2:
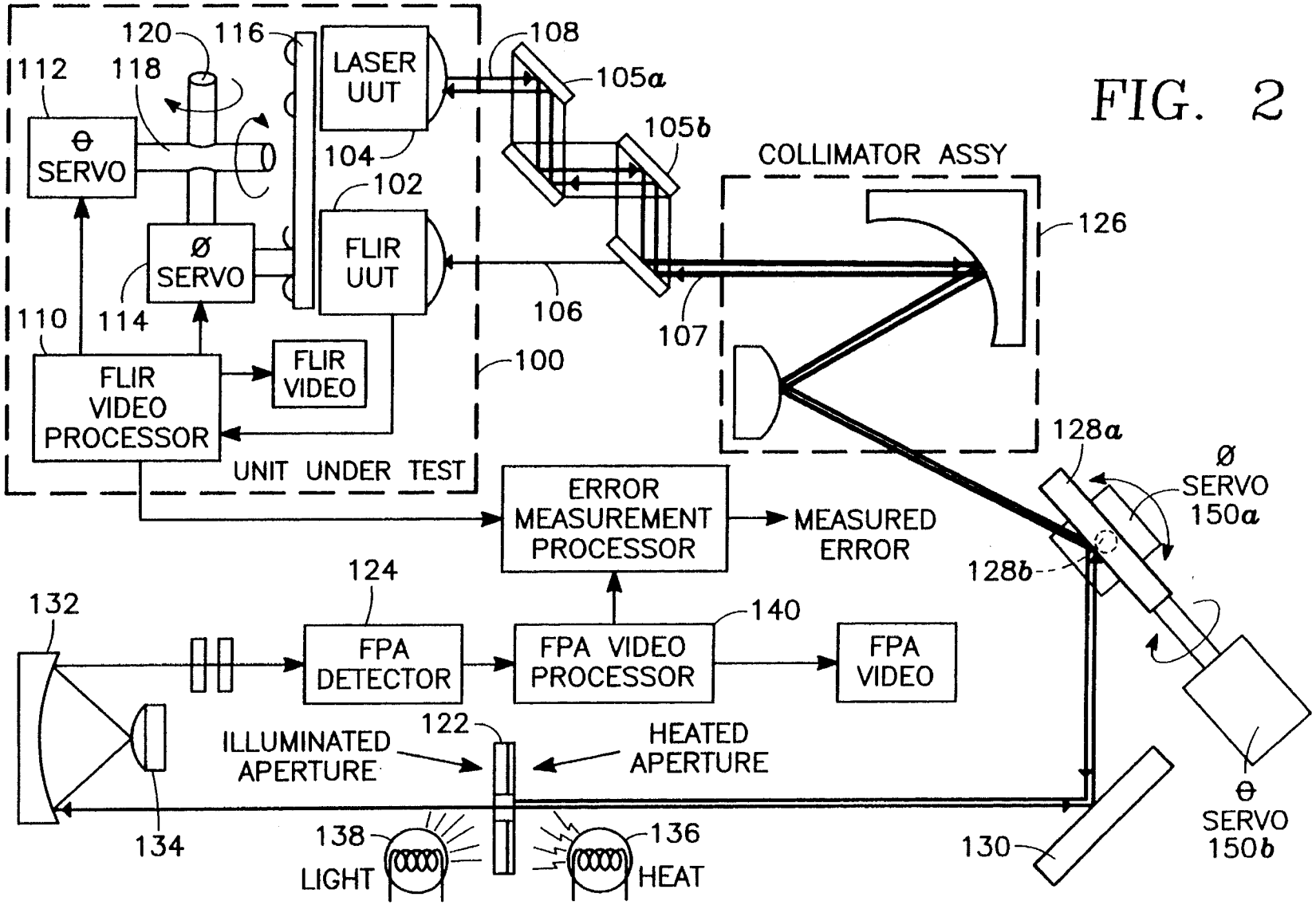
FIG. 2 is a schematic diagram of a system embodying the present invention.

Referring to FIG. 2, an optical system such as a double rhomboid assembly 105*a*, 105*b* shifts the optical path of the laser 104 into the center aperture of the FLIR 102, so that the two optical paths 106, 108 merge into a coaxial optical path 107.

Referring to FIG. 2, test equipment embodying the invention provides an optical channel from the combined optical path 107 through a target aperture 122 and terminating at a focal plane array (FPA) 124. (This optical channel is provided in the particular implementation illustrated in FIG. 2 by conventional optical elements including a collimator assembly 126, a fold mirror 128, a reflector mirror 130 and a relay mirror assembly 132, 134, which form no part of the present invention. Of course, any other suitable implementation may be employed by the skilled worker in carrying out the present invention.)

The surface of the aperture 122 viewed by the FLIR 102 is heated by a heat source 136 so as to appear as a bright border in the FLIR video image. The surface on the opposite side of the aperture 122 viewed by the FPA is illuminated by a light source 138 with visible wavelength light so as to appear as a bright border in the FPA video image. The aperture 122 and the FPA 124 are illustrated in the enlarged view of FIG. 3. The FPA video image and the FLIR video image are illustrated in FIGS. 3 and 4 respectively. The FPA video image (FIG. 4) includes an image of both the illuminated aperture surface, bordering the image in the ideal case, and an image of the laser beam corresponding to a spot at which it illuminates the FPA 124. The FLIR video image (FIG. 5) includes an image of the heated aperture 122 as a border around the periphery of the video image, indicating whether the FLIR optical axis 106 is properly aligned relative to the aperture 122.

An FPA video processor 140 processes the FPA video image of FIG. 4 using well-known techniques for locating centroids of selected objects in an image. It is the FPA video processor 140 which computes the static error (principally comprising the misalignment error between the FLIR and laser optical axes 106, 108).

Figure 6:
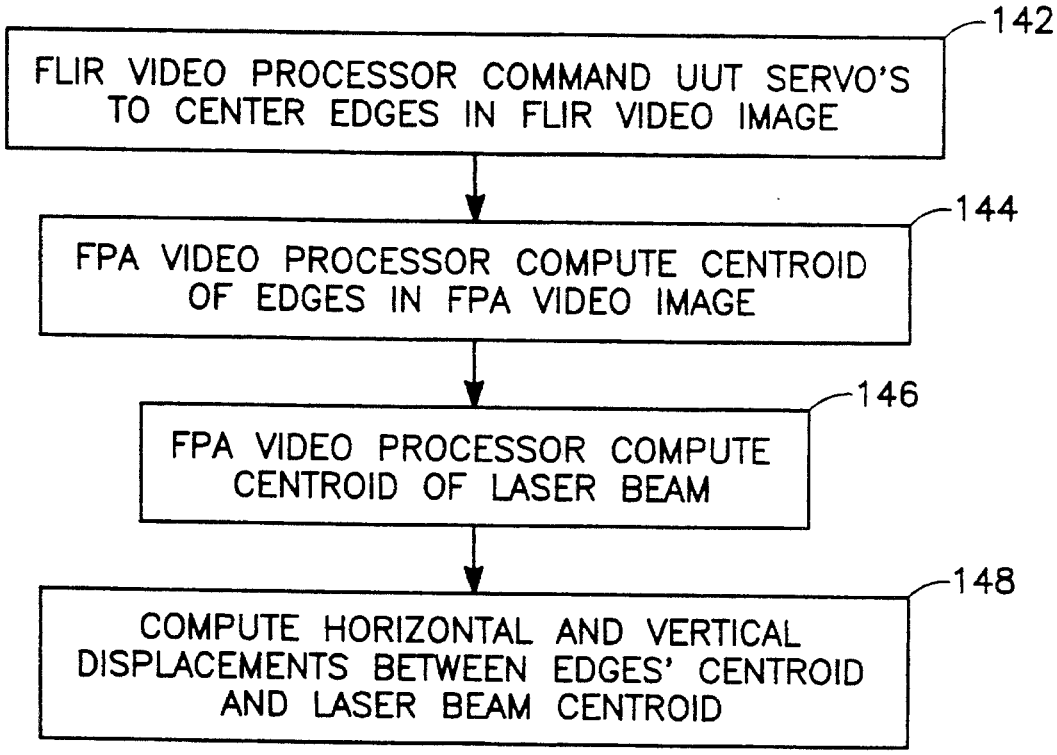
FIG. 6 is a flow diagram illustrating a process embodying one aspect of the invention in which static error is measured.

Operation of the invention in determining static error is illustrated in FIG. 6 and is as follows: The FLIR video processor 110 initially centers the image of the heated surface of the aperture 122 in the FLIR video image (FIG. 5) by commanding the servos 112, 114. It does this using conventional techniques by computing the displacement between the centroid of the aperture 122 and the center of the image, and then nulling this displacement by causing the servos to rotate the frame 116 about the horizontal and vertical axes 118, 120 as necessary. FIG. 5 illustrates the result of this centering operation, in which the image of the heated aperture surface symmetrically borders the FLIR video image. This step corresponds to the step of block 142 of FIG. 6.

Next, the FPA video processor 140 computes the centroid of the inner edges of the aperture 122 in the FPA video image of FIG. 4 in accordance with the step of block 144 of FIG. 6. This step correlates the FLIR and FPA video images, so as to make the system impervious to any misalignment or vibration between the FLIR 102 and the FPA 140. It should be noted that although FIG. 4 indicates that the image of the illuminated surface of the aperture 122 symmetrically borders the FPA video image, lack of such symmetry in the FPA image does not affect operation of the invention.

The FPA video processor 140 then computes the location of the centroid of the laser beam in the FPA video image of FIG. 4 (block 146 of FIG. 6). Finally the FPA processor 140 computes the horizontal and vertical displacements X, Y (FIG. 4) between the centroids of the aperture and beam (block 148 of FIG. 6). (As noted above, the aperture centroid may not coincide with the center of the FPA video image due to misalignment or vibration, but this does not impede operation of the invention, a significant advantage.) The displacements X and Y are then output as measurements of the static error of the laser target designator 100. The foregoing steps may be incorporated in a manufacturing process in which the position of one or the other of the FLIR 102 and laser 104 on the frame 116 is adjusted in a trial and error process so as to null out the displacements X and Y.

Measurement of Dynamic Error

The invention makes possible the measurement of dynamic error, a significant advantage. The dynamic error is measured by dithering the target image presented to the FLIR 102, so that the FLIR video processor 110 is forced to continually track a moving "target". In the specific implementation of the invention illustrated in FIG. 2, this is accomplished first by commanding the FLIR video processor 110 to track the centroid of the image of the heated surface of the aperture 122 and then by dithering the folding mirror 128 about folding mirror gimbal axes 128*a*, 128*b* with dither servos 150*a*, 150*b*. If, for example, the folding mirror 128 is gimballed in a circular precessing motion, then the FLIR video processor 110 observes a circular motion of the centroid of the aperture image over a succession of many video frames. (Of course, the dithering amplitude of the mirror motion must be sufficiently small to maintain the laser beam within the field of view of the FPA 124.)

Figure 7:
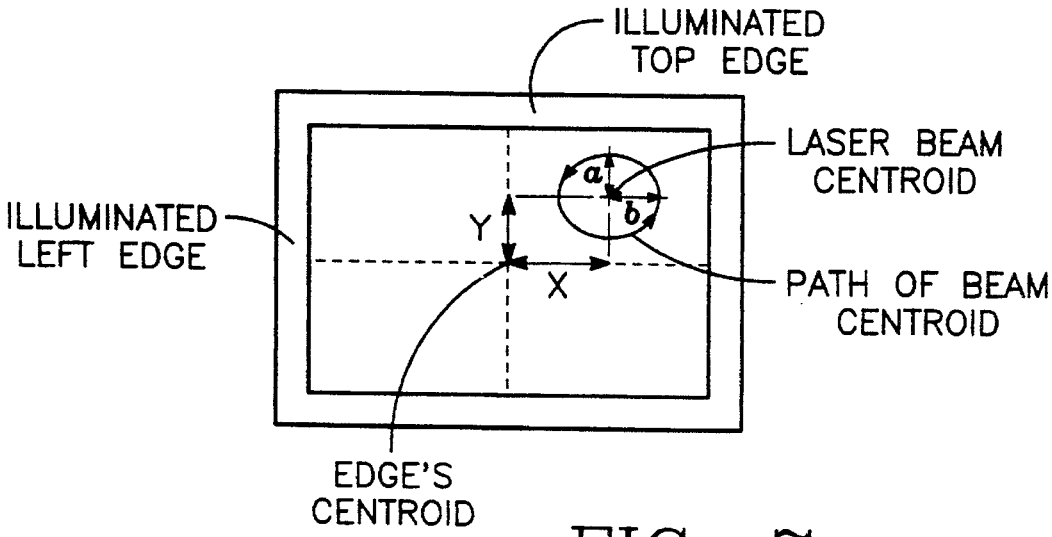
FIG. 7 is a diagram of a focal plane array video image obtained in accordance with a second process of the invention.

Assuming that there were no delays, inaccuracies or mechanical limitations in the video tracking system including the FLIR video processor 110 and the servos 112, 114, the motion of the gimballed folding mirror 128 would be followed flawlessly by servoed motion of the frame 116, so that the FPA image would remain unchanged from one video frame to the next. However, such an ideal result is not physically possible: in reality the laser beam centroid in the FPA video image of FIG. 4 follows a circular trajectory, reflecting the motion of the mirror 128, as illustrated in FIG. 7. If, for example, the delays and inaccuracies inherent in the two servos 112, 114 were different, the path followed by the laser beam centroid in the FPA image of FIG. 7 would be ellipsoidal, the vertical and horizontal elliptical axes a,b being measures of the dynamic system error in the vertical and horizontal directions, respectively. Typically, however, the path of the laser beam centroid in the FPA video image would be circular, and the radius of the circle would be the measure of the dynamic error.

As illustrated in FIG. 7, this embodiment of the invention provides an accurate simultaneous measure of both the static and dynamic errors of the laser target designator 100. The static error is indicated by the horizontal and vertical offsets X,Y in FIG. 7 between the centroid of the aperture edge and the centroid of the laser beam path (labelled "laser beam centroid" in FIG. 7). The dynamic error is the radius of the laser beam path (if circular) or the horizontal and vertical axes (labelled a and b in FIG. 7) of the laser beam path (if elliptical) .

Figure 8:
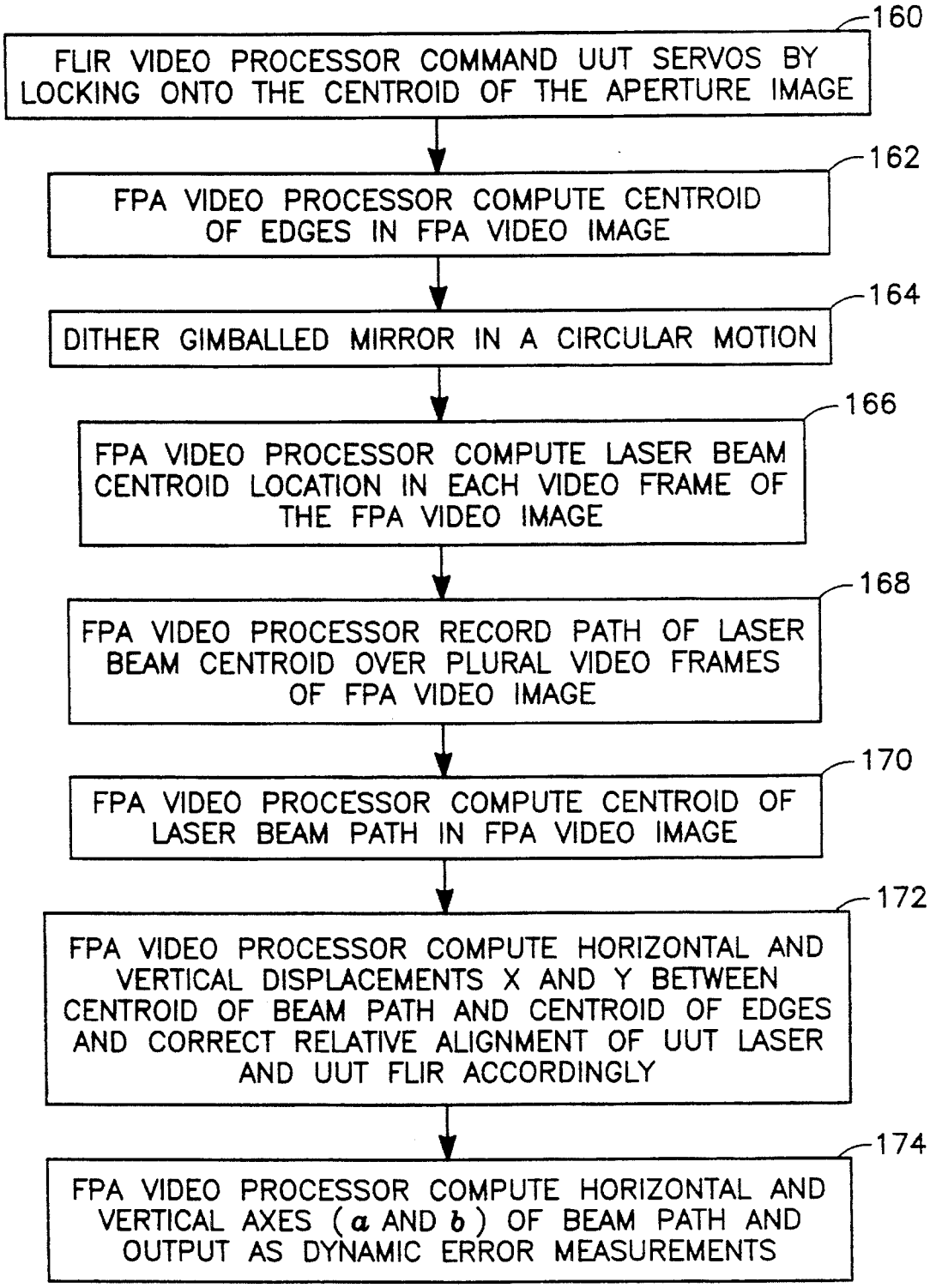
FIG. 8 is a flow diagram illustrating a second process embodying another aspect of the invention in which both static and dynamic error are measured simultaneously.

The method for measuring the dynamic error is illustrated in FIG. 8. First the FLIR video processor 110 is locked onto the centroid of the image of the heated surface of the aperture 122 in the FLIR video image (block 160 of FIG. 8). Next, the FPA video processor 140 computes or locates the centroid of the illuminated surface of the aperture 122 in the FPA video image (block 162 of FIG. 8). Then, the mirror 128 is dithered, preferably in a circular motion (block 164 of FIG. 8). The FPA video processor 140 then computes, for each successive video frame of the FPA video image, the laser beam centroid and stores it in memory (block 166 of FIG. 8). From this, the FPA video processor 140 deduces the path of the laser beam centroid over many successive video frames of the FPA video image (block 168 of FIG. 8). The static error is readily computed at this point by computing the horizontal and vertical displacements X,Y between the centroid of the laser beam centroid path and the centroid of the image of the aperture in the FPA video image (blocks 170, 172 of FIG. 8). Finally, the dynamic error is obtained by computing the radius of the laser beam centroid path—or computing the horizontal and vertical elliptical axes thereof (block 174 of FIG. 8).

The invention is further useful not only as a testing method but also as a production process, in which the step of block 172 of FIG. 8 further includes correcting the relative alignments of the UUT FLIR 102 and laser 104 in accordance with the static error X and Y so as to remove or minimize the static error characteristic of a particular UUT 100.

While the invention has been described in detail by specific reference to preferred embodiments, it is understood that variations and modifications thereof may be made without departing from the true spirit and scope of the invention.

What is claimed is:

1. An apparatus for testing a laser target designator, said laser target designator including a laser for radiating a laser beam along a beam optical axis, a target image detector for viewing an image in a field of view into which said laser beam extends along said beam optical axis, servo means for moving said laser and detector together and a video processor for tracking said servo means to a moving target in said field of view, said apparatus for testing comprising:

an aperture in said field of view, one side of said aperture facing said target image detector and said laser, said aperture being aligned relative to said laser so that said beam optical axis extends through an opening of said aperture;

a beam image detector facing an opposite side of said aperture and aligned with the opening thereof so that said beam optical axis and said opposite side of said aperture are in a field of view of said beam image detector;

means for illuminating said one side of said aperture with light of a wavelength detectable by said target image detector and means for illuminating said opposite side of said aperture with light of a wavelength detectable by said beam image detector; and beam detector video processor means responsive to a test video image received from said beam image detector for computing a centroid of said aperture in said test video image and a centroid of said laser beam in said test video image.

2. The apparatus of claim 1 wherein said beam detector video processor means provides a measure of static error present in said laser target designator equal to a displacement between said centroid of said laser beam and said centroid of said aperture in said test video image.

3. The apparatus of claim 1 further comprising:

a mirror for providing an optical path between said aperture and said laser target designator;

means for dithering said mirror while said target detector video processor is locked onto an image of said aperture;

and wherein said beam detector video processor means computes a path of said centroid of said laser beam in said test video image and outputs a radius of said path as a measure of dynamic error.

4. The apparatus of claim 1 wherein said laser emits radiation at an optical wavelength, said beam detector operates in a wavelength range including said optical wavelength, said target detector operates at an infrared wavelength and wherein said means for illuminating illuminates said one side of said aperture with light of said infrared wavelength and illuminates said opposite side of said aperture with light of said optical wavelength.

5. The apparatus of claim 1 further comprising a double rhomboid assembly facing said laser along one sub-axis and said target image detector along another sub-axis and projecting said one and other sub-axes along said optical axis.

6. A method of testing a laser target designator, said laser target designator including a laser for radiating a laser beam along a beam optical axis, a target image detector for viewing an image in a field of view into which said laser beam extends along said beam optical axis, servo means for moving said laser and detector together and a video processor for tracking said servo means to a moving target in said field of view, said method comprising:

providing an aperture in said field of view, one side of said aperture facing said target image detector and said laser, said aperture being aligned relative to said laser so that said beam optical axis extends through an opening of said aperture;

providing a beam image detector facing an opposite side of said aperture and aligned with the opening thereof so that said beam optical axis and said opposite side of said aperture are in a field of view of said beam image detector;

illuminating said one side of said aperture with light of a wavelength detectable by said target image detector and illuminating said opposite side of said aperture with light of a wavelength detectable by said beam image detector; and obtaining a test video image from said beam image detector and computing a centroid of said aperture in said test video image and a centroid of said laser beam in said test video image.

7. The method of claim 6 further comprising computing static error present in said laser target designator as a displacement between said centroid of said laser beam and said centroid of said aperture in said test video image.

8. The method of claim 6 further comprising:

providing a mirror in an optical path between said aperture and said laser target designator;

dithering said mirror while said target detector video processor is locked onto an image of said aperture; and computing a path of said centroid of said laser beam in said test video image and computing a radius of said path as a measure of dynamic error.

9. The method of claim 6 wherein said laser emits radiation at an optical wavelength, said beam detector operates in a wavelength range including said optical wavelength, said target detector operates at an infrared wavelength and wherein the step of illuminating comprises illuminating said one side of said aperture with light of said infrared wavelength and illuminating said opposite side of said aperture with light of said optical wavelength.

10. The method of claim 7 further comprising modifying a relative alignment of said laser and said target image detector so as to reduce said static error.

* * * * *